US006027577A

United States Patent [19]

Mikura et al.

[11] Patent Number: 6,027,577

[45] Date of Patent: Feb. 22, 2000

[54] MANUFACTURING METHOD OF VALVE SPRING SUPERIOR IN DURABILITY

[75] Inventors: Masaaki Mikura, Nagoya; Taisuke Nishimura; Takashi Otowa, both of Wako, all of Japan

[73] Assignees: Chuo Hatsujo Kabushiki Kaisha; Honda Giken Kogyo Kabushiki Kaisha, both of Japan

[21] Appl. No.: 09/038,976

[22] Filed: Mar. 12, 1998

[30] Foreign Application Priority Data

Mar. 12, 1997 [JP] Japan ..... 9-057336

[51] Int. Cl.[7] ..... C21D 9/02

[52] U.S. Cl. ..... 148/226; 148/230; 29/896.9; 72/53; 451/37

[58] Field of Search ..... 29/896.9; 72/53; 451/32–35, 37–39; 140/89; 148/226, 230

[56] References Cited

U.S. PATENT DOCUMENTS

| | | | |
|---|---|---|---|
| 2,249,677 | 7/1941 | Wallace | 72/53 |
| 4,604,881 | 8/1986 | Lienert | 72/53 |
| 5,665,179 | 9/1997 | Izawa et al. | 148/226 |

*Primary Examiner*—P. W. Echols
*Attorney, Agent, or Firm*—Nixon & Vanderhye PC

[57] ABSTRACT

In a manufacturing method of a valve spring, a coiled valve spring made of an oil-tempered wire is applied with nitriding treatment and is supported to be rotated about its center axis. During a shot peening process of the coiled valve spring, cut wires of Hv 650 to 850 in hardness and 1.0 to 0.6 mm in diameter are shot to the coiled valve spring at a first step, in a roller-type shot machine and cut wires of Hv 650 to 850 in hardness and 0.4 to 0.2 mm in diameter are shot to the coiled valve spring at a second step in a tumbling shot machine, the time for the second step being longer than the time for the first step.

11 Claims, 3 Drawing Sheets

PROCESS FOR MAKING COILED VALVE SPRING

PROCESS FOR MAKING COILED VALVE SPRING

| | SIGN | SAMPLE WIRE | STEP | CUT WIRE mm × Hv | SHOT SPEED m/sec | SHOT TIME min | MACHINE |
|---|---|---|---|---|---|---|---|
| COIL SPRING 1 | ◎ | 1 | 1 | 0.6 × 682 | 80 | 1 | R |
| | | | 2 | 0.3 × 733 | 60 | 30 | T |
| COIL SPRING 2 | □ | 4 | 1 | 0.6 × 682 | 80 | 1 | R |
| | | | 2 | 0.3 × 733 | 60 | 30 | T |
| COIL SPRING 3 | × | 1 | 1 | 0.7 × 560 | 70 | 30 | T |
| | | | 2 | 0.3 × 733 | 60 | 30 | T |
| COMPARATIVE COILSPRING (1) | ○ | 1 | 1 | 0.6 × 682 | 80 | 1 | R |
| | | | 2 | 0.3 × 733 | 70 | 1 | R |
| COMPARATIVE COIL SPRING (2) | △ | 1 | 1 | 0.6 × 682 | 80 | 1 | R |
| | | | 2 | 0.3 × 733 | 60 | 1 | R |
| COMPARATIVE COIL SPRING (3) | ▲ | 1 | 1 | 0.6 × 682 | 60 | 1 | R |
| | | | 2 | 0.3 × 733 | 60 | 1 | R |
| COMPARATIVE COIL SPRING (4) | ■ | 1 | 1 | 0.3 × 733 | 60 | 30 | T |

MANUFACTURING METHOD OF VALVE SPRING SUPERIOR IN DURABILITY

BACKGROUND OF THE INVENTION

1. Field of the Invention

The present invention relates to a manufacturing method of valve springs of high strength superior in durability.

2. Description of the Prior Art

As the fatigue strength of valve springs is closely related to residual compression stress on the surface of the valve springs, a method has been developed for applying higher residual compressive stress to the surface of valve springs to a depth of 0.1 to 0.2 mm. In such a conventional method, various kinds of cut wires different in diameter and hardness are shot-blasted to the valve springs at plural steps after high temperature nitriding process thereof. Japanese Patent Laid-open Publication 5(1993)-331535 disclosed a shot peening method of applying hard shot of Hv 650–850 in hardness to a coiled valve spring made of an oil-tempered wire after treatment thereof by low temperature carbo-nitriding process. As a high strength wire material of the valve springs, an oil-tempered wire has been proposed containing 0.45–0.8% C., 1.2–2.5% S1, 0.5–1.5% Mn and 0.5–2.0 Cr, by weight, and at least one metallic element selected from the group of 0.1–0.7 Mo. 0.05–0.6% V, 0.2–2.0% Ni and 0.01–0.2% Nb, by weight and containing Fe and impurity elements as a remainder.

However, when am oil-tempered wire of high strength designated as SWOCN-V is treated by high temperature carbo-nitriding process at about 500° C. the surface hardness of the wire becomes more than Hv 900. and the inner hardness of the wire becomes Hv 570. In the case that a valve spring of such an oil-tempered wire is applied with hard shot peening at plural steps such as two steps or three steps, the fatigue strength of the valve spring Is greatly enhanced. It is, however, necessary required to apply the shot peening to the valve spring for a long period of time (for instance, 1.5–2.5 hours) at plural steps in a tumbling shot machine. The shot peening causes defacement of rubber belts in the tumbling shot machine in a short period of time due to strong shot of hard materials, resulting in unexpected trouble in production of the valve springs. If the time of shot peening was shortened to enhance productivity of the valve springs, a large difference in fatigue strength would occur in each product of the valve springs. To eliminate the difference In fatigue strength in a reliable manner, it is required to reduce the number of valve springs to be applied with the shot peening. This results in reduction of productivity of the valve springs, If the speed of shot peening is lowered to reduce damage to the tumbling shot machine, the residual stress decreases in depth, resulting in a decrease of the internal fatigue strength of the valve springs. Furthermore, when the shot peening is applied at plural steps for a long period of time, it is necessary to finish each distal end of the valve springs with a round surface to prevent breakage of the valve spring caused by defacement at its distal ends.

SUMMARY OF THE INVENTION

It is, therefore, a primary object of the present invention to provide a shot peening method capable of providing a valve spring superior In fatigue strength without causing any of the problems discussed above.

According to an aspect of the present invention, this object is accomplished by providing a manufacturing method of a valve spring, comprising the steps of applying nitriding treatment to a coiled valve spring made of an oil-tempered wire, shot-blasting at a first step cut wires of Hv 650 to 850 in hardness and 1.0 to 0.6 mm in diameter to the coiled valve spring in a condition where the valve spring is being supported to be rotated about its center axis, and shot-blasting at a second step cut wires of Hv 650 to 850 in hardness and 0.4 to 0.2 mm in diameter to the coiled spring in a tumbling shot machine.

In a practical embodiment of the manufacturing method. the shot speed of the cut wires of Hv 650 to 850 in hardness and 1.0 to 0.6 mm in diameter at the first step is determined to be 50 to 90 m/sec, and the shot speed of the cut wires of Hv 650 to 850 in hardness and 0.4 to 0.2 mm in diameter at the second step is determined to be 50 to 70 m/sec. In the embodiment, it Is preferable that the oil-tempered wire contains 0.45 to 0.8% C, 1.2 to 2.5 % Si, 0.5 to 1.5% Mn and 0.5 to 2.0% Cr, by weight and at least one metallic element selected from the group of 0.1 to 0.7% Mo, 0.05 to 0.6% V, 0.2 to 2.0% Ni and 0.01 to 0.2% Nb, by weight and contains Fe and impurity elements as a remainder.

According to another aspect of the present invention, this object Is accomplished by providing a manufacturing method of a valve spring, comprising the steps of applying nitriding treatment to a coiled valve spring made of an oil-tempered wire, shot-blasting at a first step cut wires of Hv 500 to 650 in hardness and 1.0 to 0.6 mm in diameter to the coiled spring in a tumbling shot machine, and shot-blasting at a second step cut wires of Hv 650 to 850 and 0.4 to 0.2 mm in diameter to the coiled spring in the tumbling shot machine. In the manufacturing method, it is preferable that the oil-tempered wire contains 0.45 to 0.8% C, 1.2 to 2.5% Si, 0.5 to 1.5% Mn and 0.5 to 2.0% Cr, by weight and at least one metallic element selected from the group of 0.1 to 0.7% Mo, 0.05 to 0.6% V, 0.2 to 2.0% Ni and 0.01 to 0.2% Nb, by weight and contains Fe and impurity elements as a remainder.

DESCRIPTION OF THE PREFERRED EMBODIMENT

Hereinafter, a preferred embodiment of the present invention will be described in detail on a basis of certain experiments. In the following table 1, there is illustrated each chemical composition of samples 1 to 5 of oil-tempered wires used for an experiment in the embodiment.

TABLE 1

| | C | Si | Mn | Cr | Mo | V | Ni | Nb |
|---|---|---|---|---|---|---|---|---|
| Sample 1 | 0.76 | 1.45 | 0.56 | 0.52 | 0.16 | 0.47 | — | — |
| Sample 2 | 0.75 | 2.10 | 0.79 | 0.79 | 0.21 | 0.48 | — | 0.02 |
| Sample 3 | 0.75 | 2.00 | 0.71 | 1.27 | 0.21 | 0.27 | — | 0.02 |
| Sample 4 | 0.73 | 2.01 | 0.75 | 1.02 | 0.22 | 0.365 | — | 0.02 |
| Sample 5 | 0.75 | 2.01 | 0.75 | 1.02 | 0.22 | 0.365 | 1.0 | 0.02 |
| | | | | | | | | (wt %) |

Figure 1:
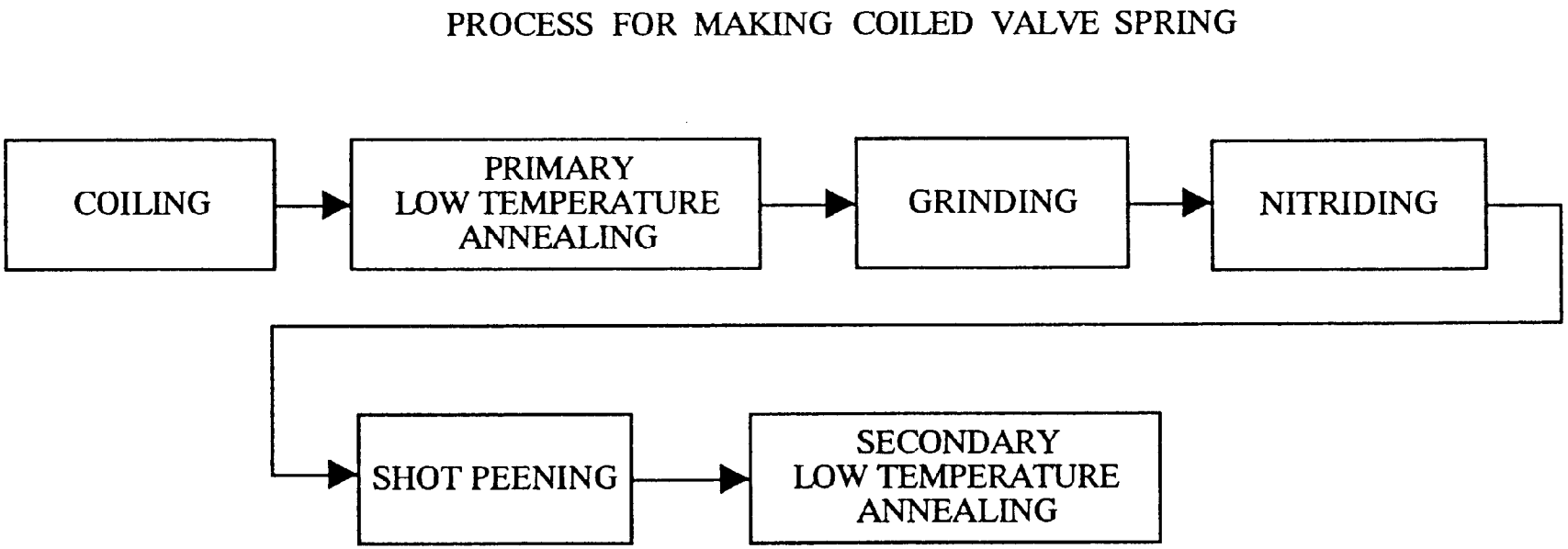
FIG. 1 is a block diagram illustrating a manufacturing process of a coiled valve spring in accordance with the present invention.

The samples 1 to 4 of oil-tempered wires of 3.4 mm in diameter were coiled as in a specification shown in the following Table 2 and treated by a manufacturing process shown in FIG. 1 to make coil springs 1 to 4. During the manufacturing process of the coil springs 1 to 4, the primary low temperature annealing was carried out at 400° C., and the nitriding treatment was carried out at 500° C. in an atmosphere of ammonia gas.

TABLE 2

| | |
|---|---|
| Wire diameter | 3.4 mm |
| Average diameter of coils | 19.4 mm |
| Effective number of windings | 4.76 |
| Total number of windings | 6.76 |
| Height in free condition | 44.6 mm |
| Spring coefficient | 3.97 kgf/mm |

Figure 2:
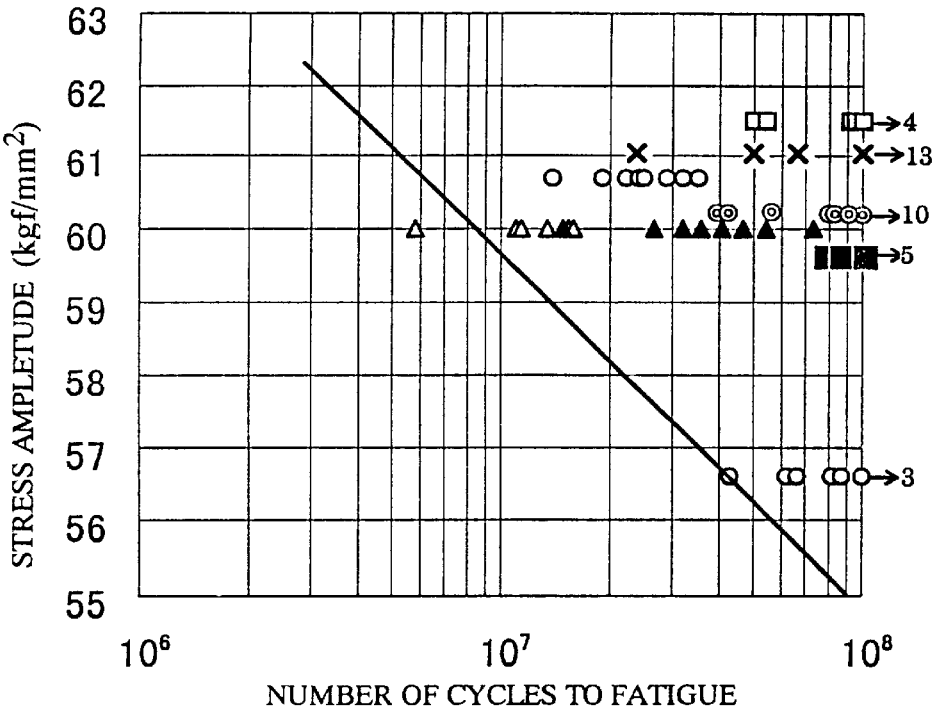
FIG. 2 is a graph showing fatigue test results of coil springs produced by the manufacturing method of the present invention.

In FIG. 2, there are illustrated fatigue test results of the coil springs 1 to 3 and comparative coil springs (1) to (4) respectively applied with shot peening treatment under conditions listed below FIG. 2. Provided that, the sample 1 of the oil-tempered wire was used for manufacturing the coil springs 1, 3 and comparative coil springs (1) to (4). and the sample 4 of the oil-tempered wire was used for manufacturing the coil spring 2. In FIG. 2, a slant solid line represents 10% breakage probability of the comparative coil spring (1). In the table listed below FIG. 2, the character R represents a continuous shot machine of the roller type, and the character T represents a tumbling shot machine. In the continuous shot machine R, the coil springs were mounted on a set of spaced rollers arranged In parallel for rotation in the same direction and shot-blasted with the cut wires during rotation with the rollers. During rotation of the rollers, the coil springs were conveyed and continuously treated with the shot peening. At the first step of the shot peening, the coil springs may be coupled with a set of parallel shafts displaceable in the form of an endless belt for rotation therewith and shot-blasted with the cut wires. In the tumbling shot-blasting machine T, the cut wires were shot to the coil springs in a usual manner.

Figure 3:
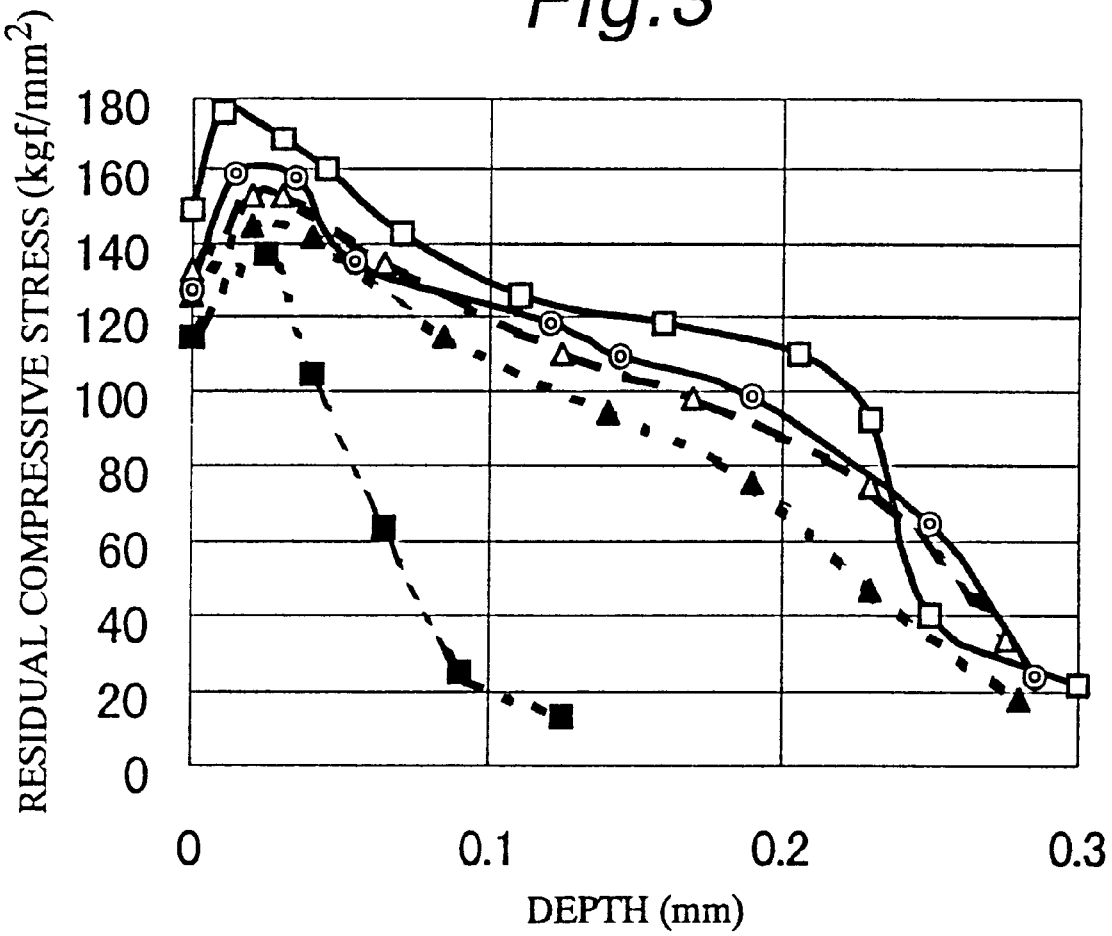
FIG. 3 is a graph showing residual compressive stress of the coil springs in relation to depth from the surface of the coil springs.

The cut wires were classified in hardness into Hv 500+50. Hv 600+50, Hv 700+50 and Hv 800+50. In the continuous shot machine R, the cut wires of 0.6 mm in diameter and Hv 682 in hardness were used to shot-blasting the coil springs 1, 2 and comparative coil springs (1) to (3) at the first step of the shot peening process. In the tumbling shot machine T, the cut wires of 0.3 mm in diameter and Hv 733 in hardness were used to shot-blast the coil springs 1 and 2 at the second step of the shot peening process. The cut wires of 0.3 mm in diameter and Hv 733 in hardness were also used in the continuous shot machine R to shot-blast the comparative coiled springs (1) to (3) at the second step of the shot peening process. The cut wires of 0.3 mm in diameter and Hv 733 in hardness were further used In the tumbling shot machine T to shot-blast the comparative coil spring (4). In the tumbling shot machine T, the cut wires of 0.7 mm in diameter and Hv 560 In hardness were used to shot-blast the embodied coiled spring 3 at the first step of the shot peening process, and the cut wires of 0.3 mm in diameter and Hv 733 in hardness were used to shot blast the coil spring 3 at the second step of the shot peening process. The cut wires of 0.3 mm in diameter and Hv 733 in hardness were further used in the tumbling shot machine T to shot blast the comparative coil spring (4). The durability of each of the coiled springs was measured by a fatigue tester under an average stress of 70 kgf/mm$^2$. and the number of test cycles to fatigue was ended at $10^8$ times, During the manufacturing process of the coil springs 1 and 2, the cut wires of Hv 682 in hardness and 0.6 mm in diameter were shot at a first step to the coil springs 1 and 2 respectively supported to be rotated about its center axis in the continuous shot machine R, and the cut wires of Hv 733 In hardness and 0.3 mm in diameter were shot at a second step to the coil springs 1 and 2 respectively in the tumbling shot machine. As shown in FIG. 2, it has been found that the coil springs 1 and 2 were superior in durability as indicated by the characters "◎" and "□", respectively. In comparison with the springs 1 and 2, the shot time of the cut wires of 0.3 mm in diameter at the second step of the shot peening process of the comparative coil springs (1) and (2) was determined to be shorter than that at the second step of the shot peening process of the coil springs 1 and 2. The shot speed of the cut wires of 0.6 mm in diameter at the first step of the shot peening process of the comparative coil spring (3) was determined to be lower than that at the first step of the shot peening process of the coil springs 1 and 2, and the shot time of the cut wires of 0.3 mm in diameter at the second step of the shot peening process of the comparative coil spring (3) was determined to be shorter than that at the second step of the shot peening process of the coil springs 1 and 2. As a result, although the comparative coil spring (3) was superior in durability in comparison with the comparative coil spring (2), the residual compressive stress of the comparative coil spring (3) decreased in depth as indicated by the character "▲" in FIG. 3. During the manufacturing process of the comparative coil spring (4). the cut wires of 0.3 mm in diameter were shot-blasted only at a first step to the comparative coil spring (4) for 30 minutes. As a result, although the comparative coil spring (4) was superior in durability as indicated by the character "■" in FIG. 2. the residual compressive stress of the comparative coil spring (4) decreased in depth as shown in FIG. 3, resulting in a decrease of internal strength. In actual use of the comparative coil spring (4), such decrease of the residual compressive stress causes breakage of the coil spring (4) in its interior, resulting in decrease of the durability.

In the foregoing experiment, the cut wires of Hv about 700 in hardness and 0.6 mm In diameter were shot-blasted at the shot speed of 80 m/sec for one minute at the first step of the shot peening process and the cut wires of Hv about 700 in hardness and 0.3 mm in diameter were shot-blasted at the shot speed of 60 m/sec for thirty minutes at the second step of the shot peening process. Alternatively, cut wires of Hv 650 to 850 in hardness and 1.0 to 0.6 min in diameter may be shot-blasted at a speed of 70 to 90 m/sec for several minutes at the first step of the shot peening process, and cut wires of Hv 650 to 850 in hardness and 0.4 to 0.2 mm in diameter may be shot-blasted at a speed of 50 to 70 m/sec for at least fifteen minutes at the second step of the shot peening process.

In the foregoing experiment, it has been found that the manufacturing method of the present invention can be effectively applied to an oil-tempered wire of high strength 0.45 to 0.8% C, 1.2 to 2.5% Si, 0.5 to 1.5% Mn containing 0.45 to 0.8% C, 1.2 to 2.5% Si, 0.5 to 1.5% Mn and 0.5 to 2.0% Cr, by weight, and at least one metallic element selected from the group of 0.1 to 0.7% Mo, 0.05 to 0.6% V, 0.2 to 2.0% Ni and 0.01 to 0.2% Nb, by weight and containing Fe and impurity elements as a remainder.

From the above description, it will be understood that in the manufacturing method of the present invention, cut wires of relatively high hardness and relatively large in diameter were used at the first step of the shot peening process to shot-blast the coil spring in a condition where the coil spring is being rotated about its center axis. As the shot speed of the cut wires was increased at the first step of the shot peening process, the coil spring was applied with residual compressive stress sufficient in depth in a short period of time. This is useful to reduce damage of the shot machine and to avoid defacement of the coil spring at its distal ends. At the second step of the shot peening process, cut wires of relatively small in diameter were used in the tumbling shot machine to shot-blast the coil spring at a relatively low speed for a long period of time. As a result, the residual compressive stress applied to the surface of the coil spring was increased and uniform. This is useful to reduce damage of the shot machine and to provide the coil spring superior In fatigue strength in comparison with the comparative coil spring B. As described above, with the manufacturing method of the present invention, the fatigue strength of the coil springs can be enhanced by the shot peening in a relatively short period of time to enhance the productivity of the coil springs and to reduce defacement of the shot machine.

During the manufacturing process of the coil spring 3, the cut wires of Hv 560 in hardness and 0.7 mm in diameter were shot-blasted at the first step to the coil spring 3 in the tumbling shot machine, and the cut wires of HV 733 in hardness and 0.3 mm in diameter were shot-blasted at the second step to the coil spring 3 in the tumbling shot machine. Although the treatment time at the first step becomes long due to lower hardness of the cut wires, defacement of the shot machine was reduced, and the fatigue strength of the coil spring 3 was enhanced by the hard shot peening at the second step as shown in FIG. 2. In the foregoing experiment, it has been found that cut wires of Hv 500 to 650 in hardness and 1.0 to 0.6 mm in diameter may be used to shot-blast the coil spring 3 at the first step and cut wires of Hv 650 to 850 in hardness and 0.4 to 0.2 mm in diameter may be used to shot-blast the coil spring 3 at the second step. It has been also found that the shot peening process of the coil spring 3 can be effectively applied to an oil-tempered wire of high strength containing 0.45 to 0.8% C, 1.2 to 2.5% Si, 0.5 to 1.5% Mn and 0.5 to 2.0% Cr, by weight, and at least one metallic element selected from the group of 0.1 to 0.7% Mo, 0.05 to 0.6 % V, 0.2 to 2.0% Ni and 0.01 to 0.2% Nb, by weight and containing Fe and impurity elements as a remainder. Although in the foregoing experiment, the shot peening was carried out for thirty minutes respectively at the first and second steps, the shot peening may be carried out for at least fifteen minutes respectively at the first and second steps to reduce the manufacturing cost of the coil springs.

What is claimed is:

1. A manufacturing method of a valve spring, comprising the steps of:

applying nitriding treatment to a coiled valve spring made of an oil-tempered wire;

shot-blasting at a first step cut wires of Hv 650 to 850 in hardness and 1.0 to 0.6 mm in diameter to the coiled valve spring for a first period of time while the coiled valve spring is being rotated about its center axis in a roller-type shot machine; and shot-blasting at a second step cut wires of Hv 650 to 850 in hardness and 0.4 to 0.2 mm in diameter to the coiled valve spring for a second period of time in a tumbling shot machine, said second period of time being longer than said first period.

2. A manufacturing method of a valve spring as claimed in claim 1, wherein the shot speed of the cut wires of Hv 650 to 850 in hardness and 1.0 to 0.6 mm in diameter at the first step is determined to be 50 to 90 m/sec.

3. A manufacturing method of a valve spring as claimed in claim 1, wherein the shot speed of the cut wires of Hv 650 to 850 in hardness and 0.4 to 0.2 mm In diameter at the second step is determined to be 50 to 70 m/sec.

4. A manufacturing method of a valve spring as claimed in claim 1, wherein the oil-tempered wire contains 0.45 to 0.8% C, 1.2 to 2.5% Si, 0.5 to 1.5% Mn and 0.5 to 2.0% Cr, in weight and at least one metallic element selected from the group of 0.1 to 0.7% Mo, 0.05 to 0.6% V, 0.2 to 2.0% Ni and 0.01 to 0.2% Nb, In weight and contains Fe and impurity elements as a remainder.

5. A manufacturing method as in claim 1, wherein said second period of time is substantially longer than said first period.

6. A manufacturing method as in claim 1, wherein said second shot-blasting step is conducted for at least 15 minutes.

7. A manufacturing method as in claim 1, wherein the first shot-blasting step is conducted for 1 to several minutes.

8. A manufacturing method of a valve spring, comprising the steps of:

applying nitriding treatment to a coiled valve spring made of an oil-tempered wire;

shot-blasting at a first step cut wires of Hv 650 to 850 in hardness and 1.0 to 0.6 mm in diameter at a shot speed of 50 to 90 m/sec to the coiled valve spring for a first period of time while the coiled valve spring is being rotated about its center axis in a roller-type shot machine; and shot-blasting at a second step cut wires of Hv 650 to 850 in hardness and 0.4 to 0.2 mm in diameter at a shot speed of 50 to 70 m/sec to the coiled valve spring for a second period of time in a tumbling shot machine, said second period of time being longer than said first period of time.

9. A manufacturing method as in claim 8, wherein said second period of time is substantially longer than said first period.

10. A manufacturing method as in claim 8, wherein said second shot-blasting step is conducted for at least 15 minutes.

11. A manufacturing method as in claim 8, wherein the first shot-blasting step is conducted for 1 to several minutes.

* * * * *